US012163334B2

(12) United States Patent
Ealer, Sr.

(10) Patent No.: US 12,163,334 B2
(45) Date of Patent: Dec. 10, 2024

(54) GUTTER COVER

(71) Applicant: E-Z Products LLC, St. Clair, MO (US)

(72) Inventor: James E. Ealer, Sr., St. Clair, MO (US)

(73) Assignee: E-Z PRODUCTS LLC, St. Clair, MO (US)

( * ) Notice: Subject to any disclaimer, the term of this patent is extended or adjusted under 35 U.S.C. 154(b) by 0 days.

(21) Appl. No.: 18/490,077

(22) Filed: Oct. 19, 2023

(65) Prior Publication Data

US 2024/0044141 A1 Feb. 8, 2024

Related U.S. Application Data

(63) Continuation of application No. 18/164,303, filed on Feb. 3, 2023, now Pat. No. 11,898,354, which is a continuation of application No. 17/343,555, filed on Jun. 9, 2021, now Pat. No. 11,591,801.

(60) Provisional application No. 63/036,586, filed on Jun. 9, 2020.

(51) Int. Cl.
*E04D 13/076* (2006.01)

(52) U.S. Cl.
CPC ..... *E04D 13/076* (2013.01)

(58) Field of Classification Search
CPC ..... E04D 13/076
USPC ..... 52/12
See application file for complete search history.

(56) References Cited

U.S. PATENT DOCUMENTS

| | | | |
|---|---|---|---|
| 2,669,950 | A | 2/1954 | Bartholomew |
| 2,674,961 | A | 4/1954 | Lake |
| 5,010,696 | A | 4/1991 | Knittel |
| 6,393,770 | B1 | 5/2002 | Groom |
| 6,463,700 | B2 | 10/2002 | Davis |
| 6,745,516 | B2 | 6/2004 | Beyers |
| 7,191,564 | B2 | 3/2007 | Higginbotham |
| 7,310,912 | B2 | 12/2007 | Lenney et al. |
| 7,765,742 | B2 | 8/2010 | Ealer, Sr. |
| 7,861,980 | B1 | 1/2011 | Verbrugge et al. |
| 7,870,692 | B2 | 1/2011 | Gregg |
| 7,891,142 | B1 | 2/2011 | Ealer, Sr. |
| 7,913,458 | B2 | 3/2011 | Higginbotham |

(Continued)

FOREIGN PATENT DOCUMENTS

| | | |
|---|---|---|
| GB | 2084210 A | 4/1982 |
| GB | 2351757 A | 1/2001 |
| GB | 2352458 A | 1/2001 |

*Primary Examiner* — Babajide A Demuren

(74) *Attorney, Agent, or Firm* — Stinson LLP

(57) ABSTRACT

A gutter cover, components thereof, and associated methods. The gutter cover is configured to be installed over a gutter to prevent debris from entering the gutter. The gutter cover can be made of a webbing material having openings through which water can pass. The gutter cover includes features that facilitate water penetration through the gutter cover for the water to enter the gutter. For example, the webbing material is formed to define a diverter protruding upward and extending lengthwise along the gutter cover body. The diverter has a peak, a rear leg extending upward and forward toward the peak, and a forward leg extending downward and forward from the peak. The rear leg is steeper and shorter than the front leg such that the rear leg defines a water impact surface configured to break surface tension of water flowing along the top of the gutter cover.

20 Claims, 13 Drawing Sheets

(56) References Cited

U.S. PATENT DOCUMENTS

| | | | |
|---|---|---|---|
| 8,037,641 | B2 | 10/2011 | Gerig |
| 8,079,183 | B2 | 12/2011 | Lenney |
| 8,146,218 | B1 | 4/2012 | Ealer, Sr. et al. |
| 8,250,813 | B2 | 8/2012 | Robins |
| 8,297,000 | B1 | 10/2012 | Demartini |
| 8,322,082 | B2 | 12/2012 | Neumann |
| 8,397,436 | B2 | 3/2013 | Higginbotham |
| 8,474,192 | B2 | 7/2013 | Horton |
| 8,479,454 | B2 | 7/2013 | Lenney et al. |
| 8,528,262 | B2 | 9/2013 | Horton et al. |
| 8,578,658 | B2 | 11/2013 | Snell |
| 8,635,811 | B2 | 1/2014 | Horton |
| 9,010,029 | B2 | 4/2015 | Higginbotham |
| 9,010,030 | B2 | 4/2015 | Davis |
| 9,021,747 | B2 | 5/2015 | Lenney et al. |
| 9,163,406 | B1 | 10/2015 | Ealer, Sr. |
| 9,212,490 | B1 | 12/2015 | Ealer, Sr. |
| 9,422,722 | B2 | 8/2016 | Iannelli |
| 9,487,955 | B2 | 11/2016 | Breyer et al. |
| 9,650,788 | B1 | 5/2017 | Ealer, Sr. |
| 9,765,524 | B2 | 9/2017 | Lenney |
| 9,771,720 | B2 | 9/2017 | Martin |
| 9,863,150 | B2 | 1/2018 | Lenney |
| 9,869,094 | B2 | 1/2018 | Lenney |
| 9,890,535 | B2 | 2/2018 | Breyer et al. |
| 9,915,070 | B2 | 3/2018 | Lenney |
| 9,976,309 | B2 | 5/2018 | Lenney |
| 10,233,648 | B2 | 3/2019 | Lenney |
| 10,519,668 | B1 | 12/2019 | Bachman |
| 2006/0117670 | A1 | 6/2006 | Tsioris |
| 2007/0214731 | A1 | 9/2007 | Bachman et al. |
| 2009/0107053 | A1 | 4/2009 | Guilford |
| 2011/0041414 | A1 | 2/2011 | Bell |
| 2013/0091780 | A1 | 4/2013 | Robins |
| 2013/0160378 | A1 | 6/2013 | Higginbotham |
| 2013/0284650 | A1 | 10/2013 | Higginbotham |
| 2014/0000179 | A1 | 1/2014 | Ealer, Sr. |
| 2015/0020462 | A1 | 1/2015 | Iannelli |
| 2015/0089883 | A1* | 4/2015 | Peck ..... E04D 13/076 52/12 |
| 2016/0060870 | A1 | 3/2016 | Martin |
| 2018/0087279 | A1 | 3/2018 | Lenney |
| 2019/0211562 | A1 | 7/2019 | Lenney |
| 2019/0218782 | A1 | 7/2019 | Miller, Jr. et al. |
| 2019/0234075 | A1 | 8/2019 | Breyer |
| 2021/0102379 | A1 | 4/2021 | Moran |
| 2021/0270041 | A1* | 9/2021 | Mischker ..... E04D 13/076 |

* cited by examiner

GUTTER COVER

CROSS-REFERENCE TO RELATED APPLICATION

The present application claims priority to U.S. patent application Ser. No. 18/164,303 filed Feb. 3, 2023, which claims priority to U.S. patent application Ser. No. 17/343,555 filed Jun. 9, 2021 (issued as U.S. Pat. No. 11,591,801), which claims priority to U.S. Provisional Patent Application No. 63/036,586, filed Jun. 9, 2020, each of which is hereby incorporated by reference in its entirety for all purposes.

FIELD

The present disclosure generally relates to gutter covers, components thereof, and associated methods.

BACKGROUND

Various types of gutter covers are used to obstruct debris (e.g., leaves, pine needles, etc.) from entering and clogging gutters. Desirably, a gutter cover permits water to flow through the gutter cover into the gutter to be collected in and flow along the gutter to a downspout. Ideally, leaves and other debris obstructed from entering the gutter by the gutter cover are washed off the cover by water or are blown off the cover by wind.

Many varieties of gutter covers are available. Some gutter covers comprise expanded metal having a plurality of generally diamond-shaped openings to permit water to pass therethrough. Other types of gutter covers comprise perforated metal having punched or cut openings to permit water to pass therethrough. Other types of gutter covers use a screen or mesh (e.g., formed of woven wires) having small openings through which water can pass into the gutter.

SUMMARY

In one aspect, a gutter cover for covering a gutter comprises a gutter cover body including an upper face and a lower face. The gutter cover body includes a front end, a rear end, and a width extending therebetween. The gutter cover includes a left end, a right end, and a length extending therebetween. The front end is configured to be located adjacent to a front lip of the gutter when the gutter cover is installed on the gutter with the upper face facing upward and the lower face facing the gutter. The gutter cover body comprises mesh material configured to permit water to pass therethrough into the gutter. The mesh material defines a water diverter configured to divert water from the upper face to pass through the mesh material. The water diverter protrudes upwardly to define a ridge extending lengthwise along the gutter cover body. The ridge includes a water impact surface arranged to cause water flowing forward along upper face of the gutter cover body to impact the impact surface to promote penetration of water through the webbing material at the impact surface.

In another aspect, a gutter cover for covering a gutter comprises a gutter cover body including an upper face and a lower face. The gutter cover body includes a front end, a rear end, and a width extending therebetween. The gutter cover includes a left end, a right end, and a length extending therebetween. The front end is configured to be located adjacent to a front lip of the gutter when the gutter cover is installed on the gutter with the upper face facing upward and the lower face facing the gutter. The gutter cover body comprises mesh material configured to permit water to pass therethrough into the gutter. The mesh material defines a channel protruding downwardly and extending lengthwise along the gutter cover body. The channel includes a water impact surface arranged to cause water flowing forward along the upper face of the gutter cover body to impact the impact surface to promote penetration of water through the webbing material at the impact surface.

In yet another aspect, a gutter cover for covering a gutter comprises webbing material including an upper face and a lower face. The webbing material includes a front end, a rear end, and a width extending therebetween. The webbing material includes a left end, a right end, and a length extending therebetween. The gutter cover includes an edge strip defining a pocket in which at least one of the front end or the rear end of the webbing material is received. The edge strip is crimped to secure the webbing material in the pocket. The crimp comprising a continuous bead crimp extending lengthwise with respect to the webbing material.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Gutter covers having screen or mesh material (or other types of material) with small openings therein can be very effective for preventing debris from passing into the gutter. However, with these types of gutter covers, surface tension of water can prevent water from passing through the screen or mesh into the gutter. The surface tension of the water can cause the water to flow across a top of the gutter cover and flow over a front lip of the gutter such that the water is not captured by the gutter. Instead of the water passing through the gutter cover into the gutter, the water flows over the gutter cover to the ground or other surface below the gutter.

The gutter cover 10 of the present disclosure has small openings such that the gutter cover is very effective in preventing debris from passing into the gutter. As explained in further detail below, the gutter cover 10 includes features that enhance water penetration of the gutter cover. The features overcome surface tension of the water so the water more readily passes through the cover. The gutter cover also includes features that increase the strength of the cover to bridge the top opening of the gutter, even under load of water, wet leaves, and/or snow.

Figure 1:
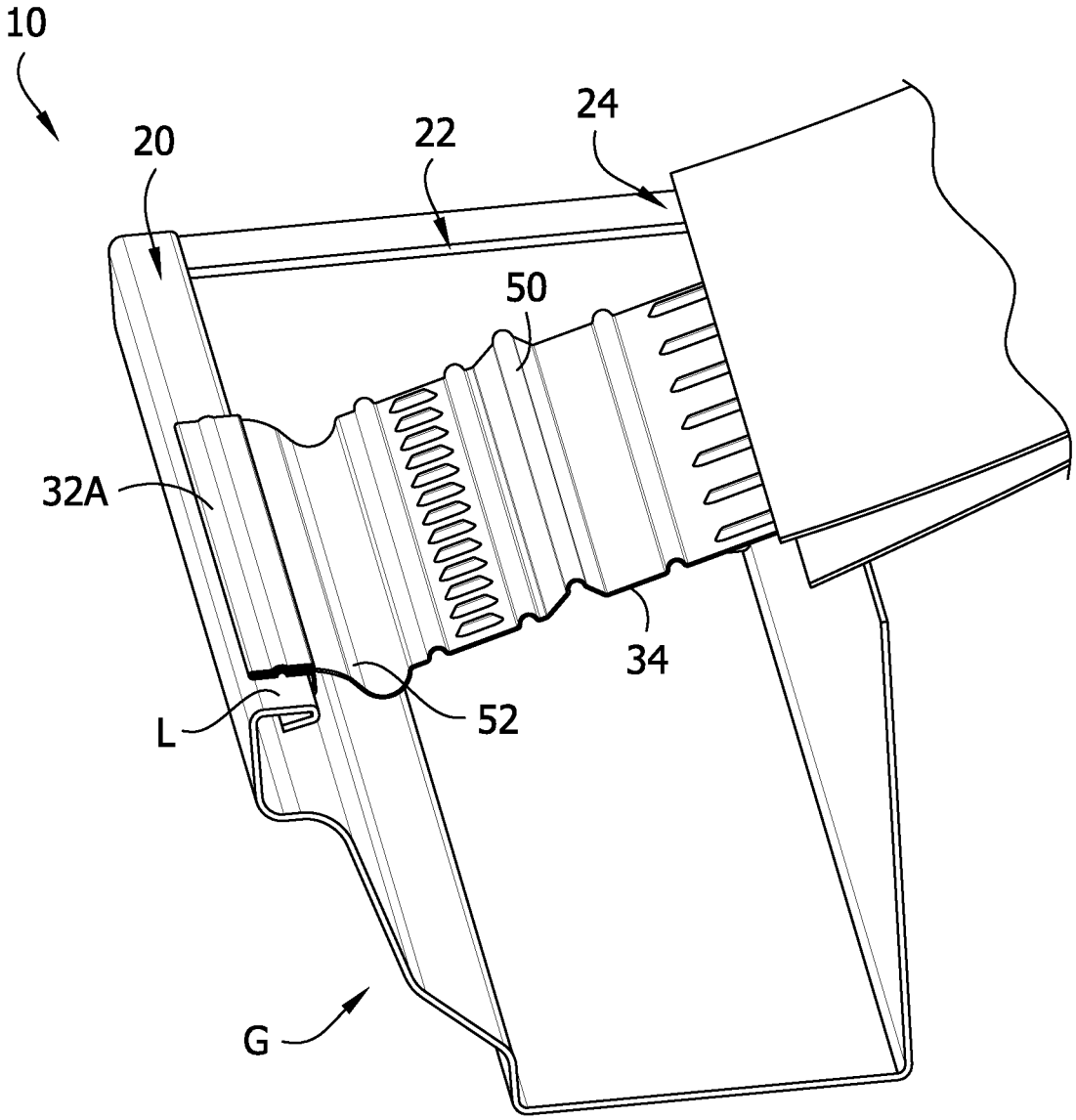
FIG. 1 is a perspective of a first embodiment of a gutter cover of the present disclosure installed on a gutter.

Referring to FIG. 1, the gutter cover 10 includes an upper face (facing upward), a lower face (facing downward), a front end (to the left, on a front lip L of the gutter G), a rear end (to the right, under shingles of the roof), a left end (pointing into the page), and a right end (pointing out of the page). The gutter cover 10 has a length extending between the opposite left and right ends, and has a width extending between the front and rear ends. When the cover is installed on a gutter G, the front end of the cover rests on a front lip L of the gutter, and the rear end of the cover is received under shingles of a roof adjacent the gutter. In general, the cover covers a top opening or mouth of the gutter. The upper face of the cover faces generally away from the gutter, and the lower face faces generally toward an interior of the gutter. As will become apparent, the gutter cover has a front gutter mounting section 20, an intermediate water collection section 22, and a rear connection section 24 (e.g., for connecting to a roof adjacent the gutter). The gutter cover may be sold in 4' lengths, or other suitable lengths. It will be appreciated that the gutter cover may connect to the gutter/roof in other ways (e.g., not be received under shingles of the roof, may rest on gutter hanger, may "snap" in by friction or interference fit between front lip of gutter and rear portion of gutter, etc.) without departing from the scope of the present disclosure.

Figure 2:
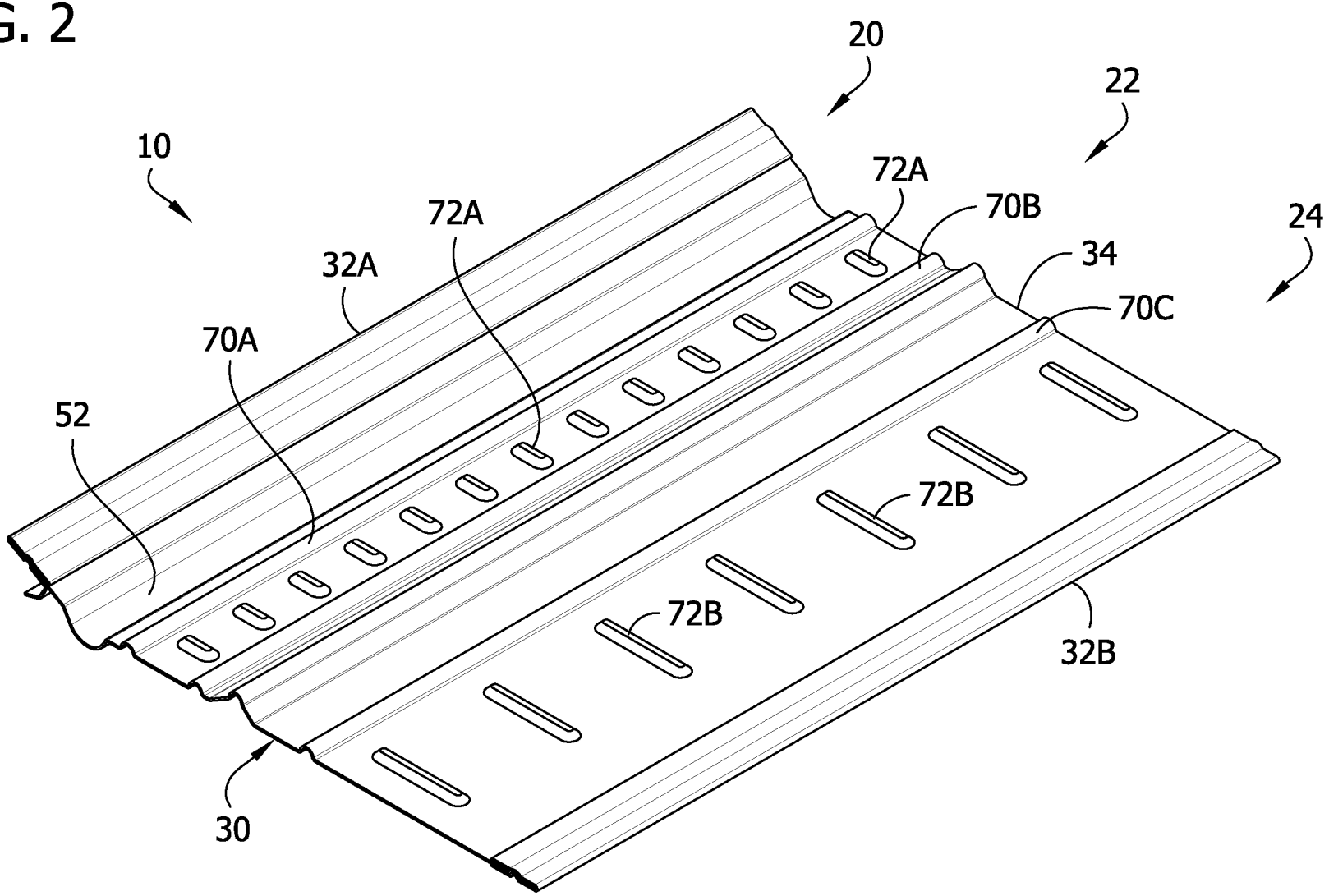
FIG. 2 is a perspective of the gutter cover of FIG. 1.

Referring to FIG. 2, the gutter cover 10 includes a semi-rigid main body 30 and front and rear edge strips 32A, 32B. The main body 30 comprises a web 34 made of a webbing material, such as screen or mesh. For example, the webbing material can comprise a plurality of wires woven or otherwise arranged in a grid fashion to define openings (e.g., openings having a square, rectangular, or other shape) between the wires through which water can pass. The wires can be made of stainless steel, a different type of metal, or any other suitable material. It will be appreciated that webbing material (e.g., perforated, expanded, molded, etc.) other than screen or mesh can be used. The web can have a continuous, uniform construction, or may be discontinuous or include different segments of various types of construction.

Desirably, the openings in the webbing material are "small openings," which, as used herein, refers to openings having a width equal to or less than 3/16". More desirably, the openings are equal to or less than 1/8" wide. More desirably, the openings are "micro openings," which as used herein, refers to openings having a width equal to or less than 1/16" (e.g., about 1/32" wide or less). Small and micro openings are effective in preventing debris from passing through the webbing material, but surface tension of water may hinder the water from passing through the webbing material.

In one example, the webbing material comprises 14 gauge wire, and the mesh size is 28×28 (28 wires per inch in a first direction, and 28 wires per inch in a second direction transverse to the first direction). Another example is 16 gauge wire with 26×26 mesh size. Such webbing material has openings measuring approximately 0.025" across each opening.

The edge strips 32A, 32B defining the front and rear ends of the gutter cover 10 are connected to front and rear edge margins of the web 34. The edge strips 32A, 32B assist in providing rigidity to the gutter cover and in connecting the gutter cover to the gutter and/or roof. The front edge strip 32A defines a gutter mount having a downwardly extending flange 36 and a recess 38 configured to receive the front lip of the gutter. Optionally, the front edge strip 32A can be fastened (e.g., by screws) to the front lip of the gutter. The edge strips 32A, 32B can be made of metal or another suitable material. For example, the edge strips 32A, 32B can be made of aluminum.

Figure 5:
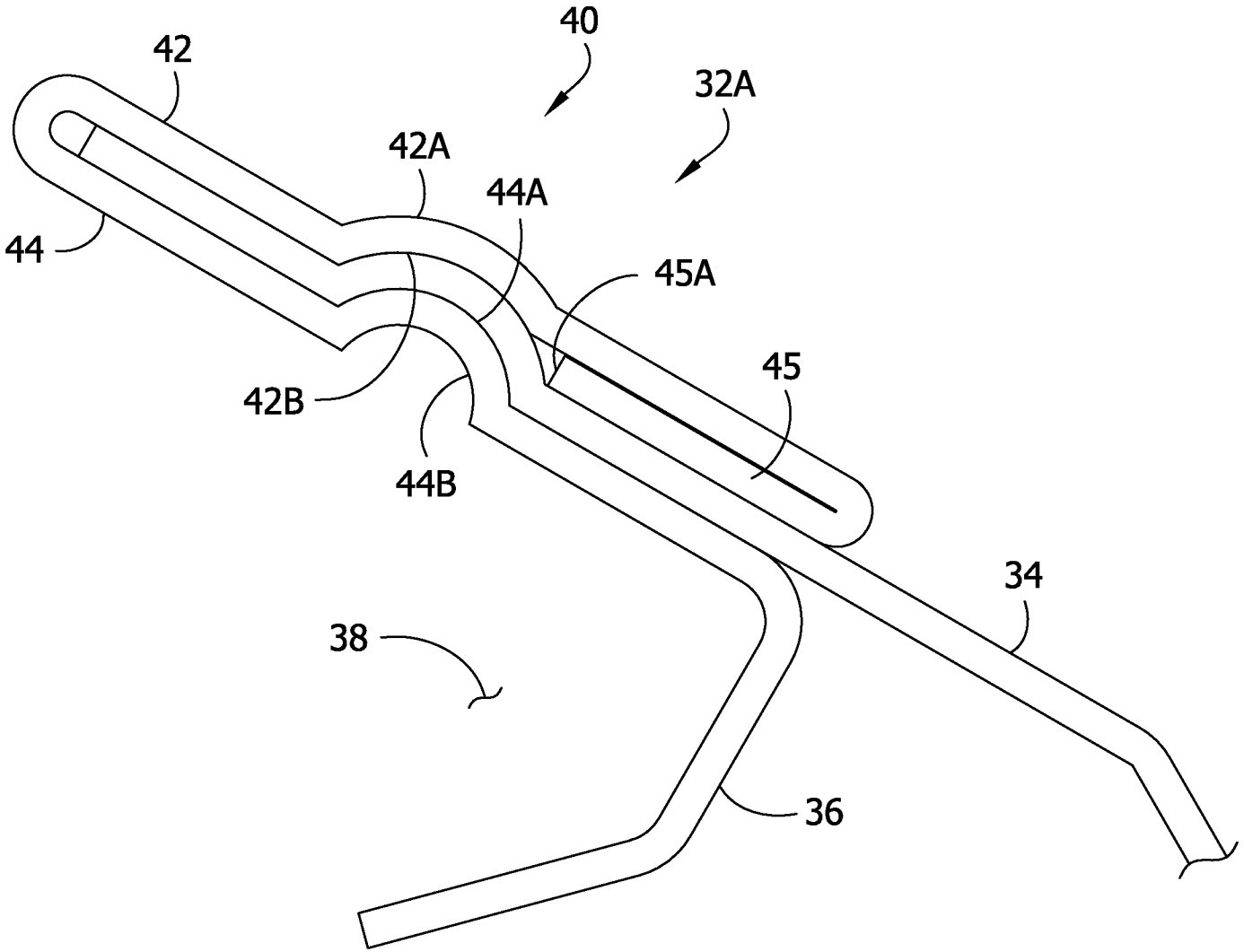
FIG. 5 is an enlarged fragmentary view of a front portion of the gutter cover.
Figure 6:
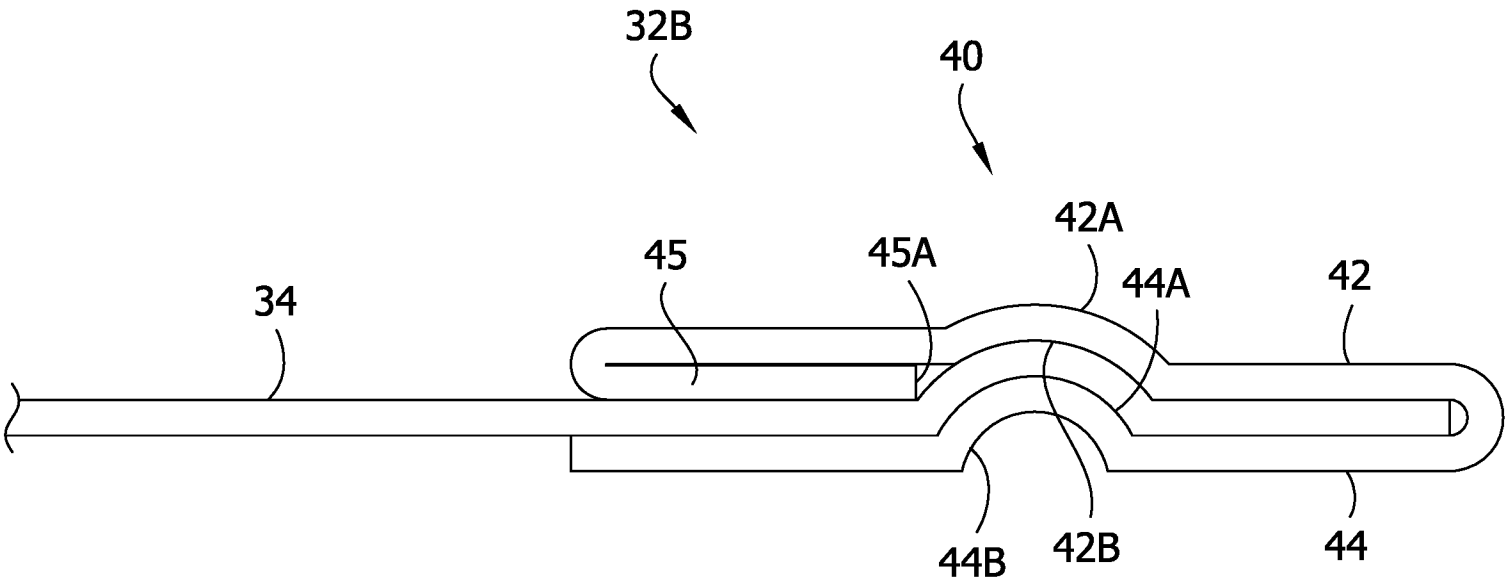
FIG. 6 is an enlarged fragmentary view of a rear portion of the gutter cover.

As shown in detail in FIGS. 5 and 6, in the illustrated embodiment, the edge strips 32A, 32B are connected to the web 34 by crimping. More specifically, the edge strips 32A, 32B are connected to the web by continuous bead crimps 40, which may be referred to as bead lock crimps. The edge strips 32A, 32B include upper and lower portions 42, 44 defining a pocket therebetween into which the edge margin of the web 34 is received. In manufacture, when the edge margin of the web 34 is received in the pocket, the edge strip 32A, 32B is crimped to secure the web in the pocket. For example, the continuous crimp 40 can be formed by a roll former, or by other forming tools. The continuous crimping results in a raised bead 42A extending continuously along the upper surface of the upper portion 42, and results in a corresponding channel 44B extending continuously along a lower surface of the lower portion 44. The continuous crimping also results in a continuous raised bead 44A in the pocket (on an upper surface of the lower portion 44) pressing the web 34 into a corresponding continuous channel 42B (on a lower surface of the upper portion 42). The edge strips 32A, 32B include in-turned lips 45 defining locking edges 45A (broadly, "locks") adjacent the raised bead 44A, which engages the web 34 to assist in preventing removal of the crimped web 34 from the pocket. The continuous bead crimp 40 has been found to result in a strong and robust connection of the edge strip 32A, 32B and web. It will be understood that the crimp can be applied in an opposite fashion, such that the beads 42A, 44A face downward instead of upward, and the channels 42B, 44B face upward instead of downward. Moreover, other types of crimping or other connections can be used for connecting the web and edge strips. For example, the edge strips can be formed integrally with the web, or the edge strips can be overmolded onto the web.

As mentioned above, the gutter cover 10 is configured to overcome surface tension of water to promote water penetration through the gutter cover into the gutter. The gutter cover 10 includes various features that facilitate water penetration. For example, the web 34 includes a water diverter 50 configured to divert water from the upper face of the cover to pass through the web. The web also includes a channel 52 configured to promote water passage through the web. As water flows from the shingles of the roof onto the upper face of the gutter cover 10, the water will flow downward, toward the front of the gutter cover. The water flowing along the upper face of the cover will encounter the diverter 50, which will cause a substantial amount of the water (e.g., more than 50% or perhaps more than 75% of the water) to pass through the web into the gutter. Water that remains on the upper face of the cover downstream from the diverter 50 will pass through the web at the channel 52 and enter the gutter.

Figure 3:
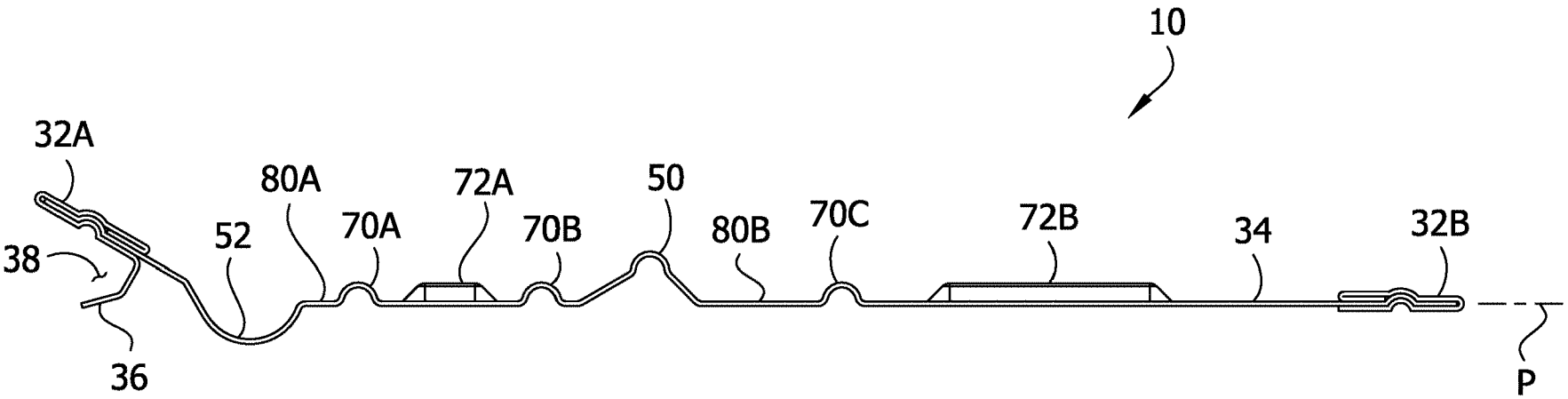
FIG. 3 is a right side elevation of the gutter cover.
Figure 4:
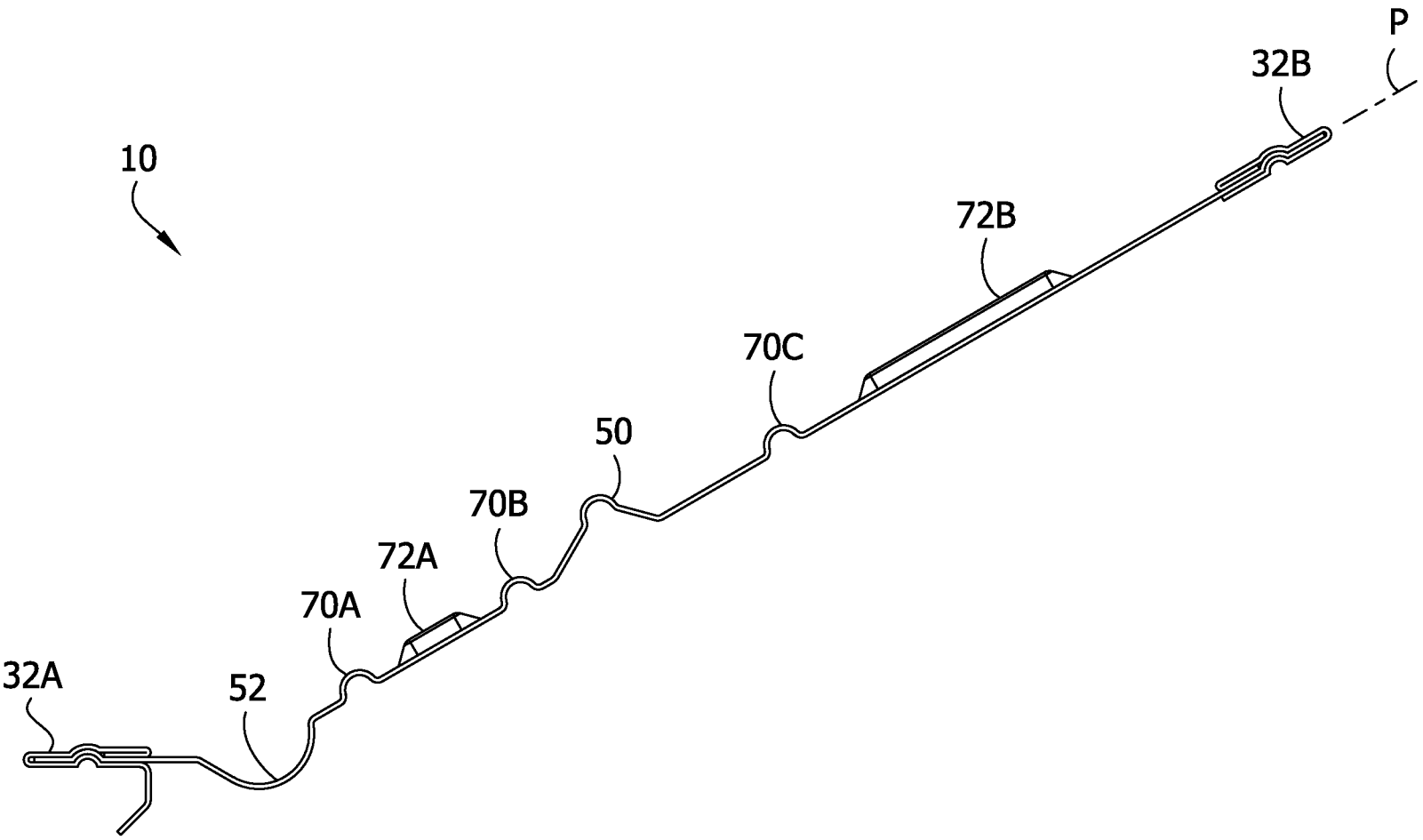
FIG. 4 is a right side elevation of the gutter cover oriented as when installed on a gutter.

Referring to FIGS. 3 and 4, the web 34 extends generally in a reference plane P. Various segments of the web 34 extend in the reference plane P. The web 34 deviates from the reference plane P at various formations in the web, such as at ridges (including beads and ribs) and channels in the web. Other configurations can be used without departing from the scope of the present disclosure. When the gutter cover is installed on a gutter, the reference plane P will be generally parallel to a plane of the roof (e.g., surface plane of shingles of the roof). In FIG. 3, the gutter cover 10 is oriented such that the plane P is horizontal, and in FIG. 4, the gutter cover is shown having the rear end higher than the front end in an orientation approximating an installed orientation on a gutter/roof (e.g., on a roof having about 6/12 pitch).

The diverter 50 comprises a ridge formed in the web 34 that protrudes upward and extends lengthwise along the cover 10. The diverter 50 is located widthwise of the cover at an intermediate portion of the web 34, rearward from the channel 52, and about midway between the front and rear ends of the gutter cover. The diverter 50 has a height of about 0.25" (e.g., in the inclusive range from about 3/16" to about ½"). In the illustrated embodiment, the diverter 50 extends continuously along the length of the web 34, from the left end of the cover to the right end of the cover.

Figure 7:
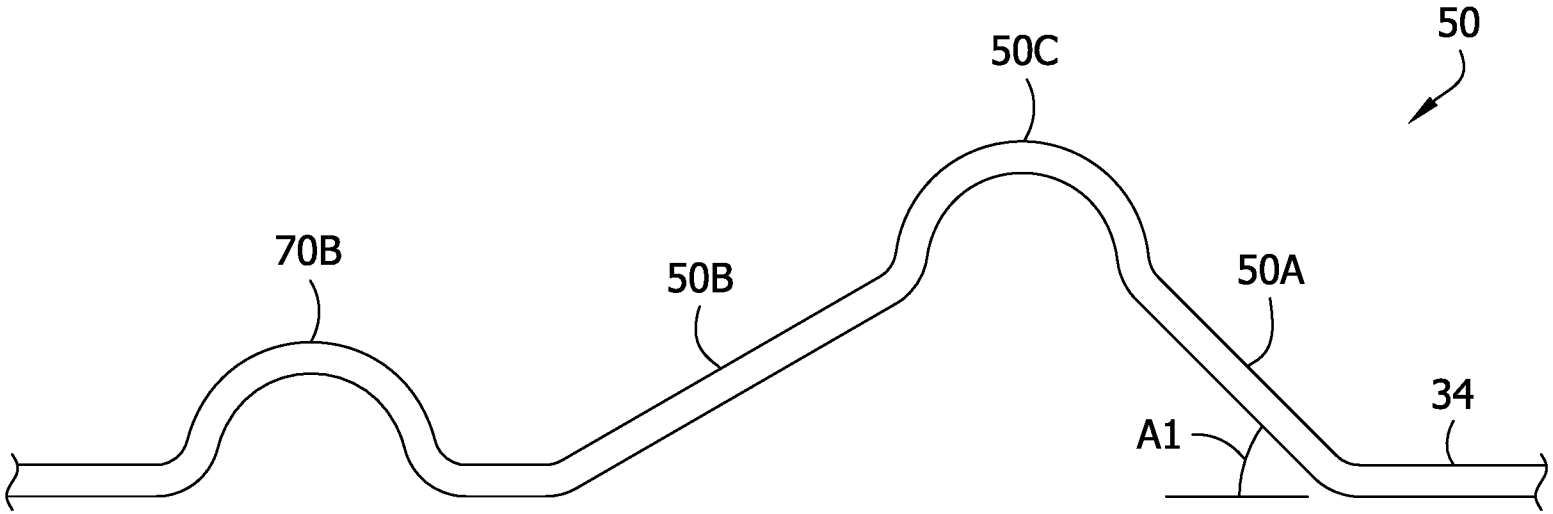
FIG. 7 is an enlarged fragmentary view of a rear intermediate portion of the gutter cover.

Referring to FIG. 7, as viewed in cross section, the diverter 50 includes a straight rear leg 50A extending upward toward a peak of the diverter, and a straight forward leg 50B extending downward away from the peak of the diverter. In the illustrated embodiment, the diverter 50 has a bead cap 50C defining the peak of the diverter. The bead cap is bulbous and has a radius bend that protrudes upward relative to the rear and forward legs 50A, 50B. The rear and forward legs 50A, 50B extend from the bead cap 50C in a non-tangent manner with respect to the radius bend of the bead cap. In the illustrated embodiment, the rear leg 50A is shorter than the forward leg 50B. The rear leg 50A deviates from the reference plane P at an angle A1 of about 45 degrees (e.g., in the inclusive range of 25 to 80 degrees, more desirably in the inclusive range of 30 to 60 degrees). The arrangement is such that, as the water flows downward along the upper face of the gutter cover 10, the water impacts the rear leg 50A. The water also impacts a rear portion of the bead cap 50C that protrudes upward with respect to the rear leg 50A. The rear leg 50A and bead cap 50C define water impact surfaces of the diverter 50. Impact of the water against the impact surfaces breaks the surface tension of the water and causes water to pass through the web 34. It will be appreciated that the forward leg 50B is oriented to extend away from the rear leg 50A to provide clearance to permit water passing through the rear leg to fall to the gutter rather than impact an underside of the forward leg and flow down the underside of the web 34 or flow back through the web to the upper face at the forward leg.

It will be appreciated that other configurations of water diverters can be used without departing from the scope of the present disclosure. For example, the bead cap 50C may be omitted, the legs 50A, 50B may not be straight, the legs may have lengths in other proportions with respect to each other, and/or the forward leg may be omitted. Moreover, in some embodiments, the diverter may be omitted.

Figure 8:
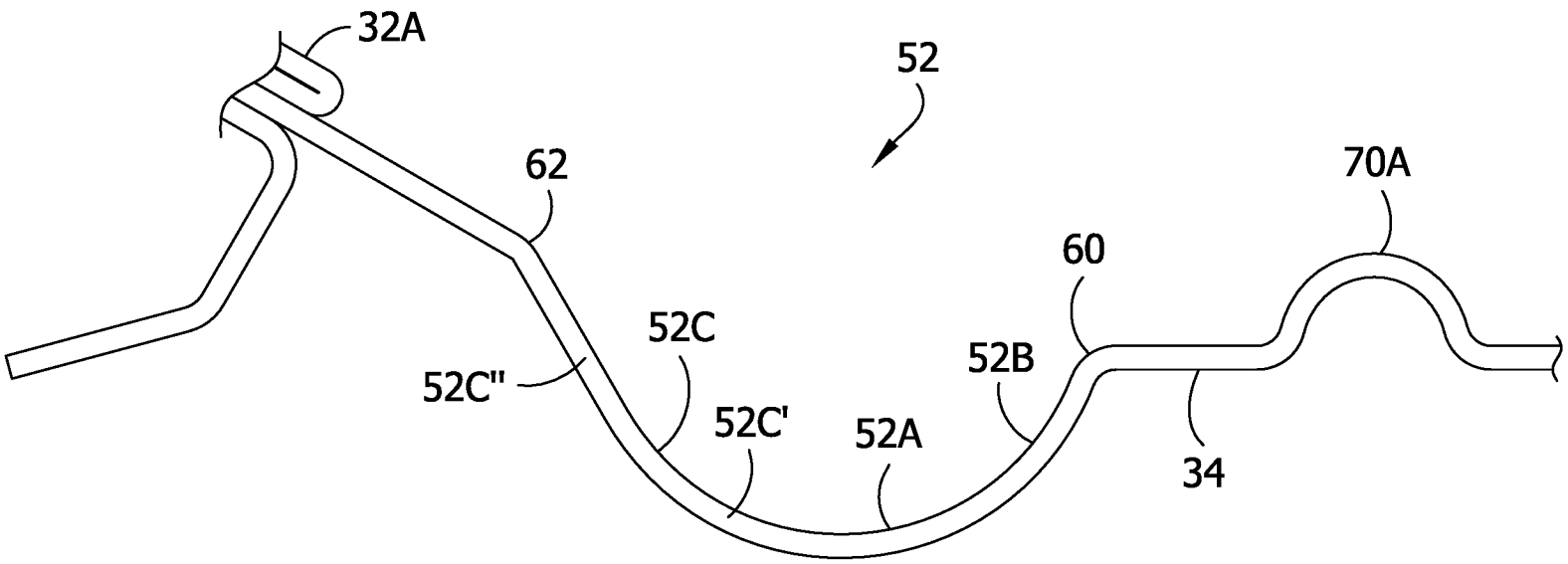
FIG. 8 is an enlarged fragmentary view of a forward intermediate portion of the gutter cover.

As shown in FIG. 8, the channel 52 is located near the front end of the gutter cover. The channel 52 is located on the cover to be adjacent the front lip of the gutter and to extend to a location below the front lip of the gutter when the cover is installed on the gutter. In the illustrated embodiment, in cross section, the channel 52 has a generally inverted arcuate or arch shape. The channel comprises an arcuate base 52A (intermediate portion), and nonparallel rear and forward portions 52B, 52C diverging from each other as they extend rearward and forward, respectively, away from the base 52A. In the illustrated embodiment, the channel 52 is configured generally as a radius bend having a radius of about 0.25" (broadly, in the inclusive range from ⅛" to 1").

Referring to FIG. 8, the rear portion 52B of the channel 52 is curved and extends downward from a ridge 60 defined by a downward bend from a segment of the web extending in the reference plane P. From the ridge 60, the channel 52 extends downward, forward, and upward in an arcuate path in front of the ridge 60. The forward portion 52C of the channel 52 includes a curved segment 52C' and a segment 52C" extending in a straight line tangentially from the curved segment. The channel 52 ends at a ridge 62 defined by another downward bend in the web 34, from which the web extends in a generally straight line to the front edge strip 32A.

The arrangement is such that water flowing down the upper surface of the gutter cover 10, drops from the ridge 60 into the channel 52, and impacts a forward impact surface of the channel defined by the forward portion 52C and/or base 52A of the channel. The impact of the water against the impact surface breaks the surface tension of the water and causes the water to pass through the web 34. In the illustrated embodiment, the reference plane P intersects the impact surface. The water passes through the web 34 at the channel 52, inboard of the forward lip of the gutter, and falls into the gutter.

The configuration of the channel 52 permits the water to drop into the impact surface 52C, 52A, yet the configuration of the channel does not cause the channel to be prone to collecting debris. The shape of the channel 52, and the flow path of water dropping into and impacting the channel, causes debris that might fall into the channel to bounce out of the channel or to be readily washed out of the channel. The configuration of the channel 52 also permits wind to readily blow debris out of the channel. In the installed orientation of the gutter cover 10, the base 52A of the channel 52 is not substantially lower than the second ridge 62, and the transition of the channel from the base 52A to the forward portion 52C, and transition of the web 34 from the channel 52 over the second ridge 62, is not substantially prone to collecting debris in the channel. In the illustrated embodiment, the forward portion 52C of the channel 52, and the channel between the ridges 60, 62, is free of a bend defining a corner or an angle of 90 degrees or less (more broadly, 125 degrees or less, even more broadly 145 degrees or less). From the forward ridge 62, the forward portion 52C of the channel 52 extends rearward and downward (e.g., slopes) in a manner that does not substantially impede debris from exiting the forward end of the channel over the forward ridge 62.

In broad terms, the channel 52 comprises an arcuate bend (e.g., a radius bend having a radius greater than 1/32", or, more desirably, greater than ⅛") bounded by at least one ridge (e.g., the rear ridge 60 or front ridge 62), or bounded by two ridges (e.g., both rear and front ridges 60, 62). Broadly speaking, the channel 52 is bounded by the two ridges 60, 62 and has a mouth (extending between the two ridges) that is wider than the base 52A of the channel.

It will be appreciated that other configurations of channels can be used without departing from the scope of the present disclosure. For example, the channel can have other cross-sectional shapes. Moreover, the channel may be omitted in some embodiments.

The gutter cover 10 includes strengthening features configured to assist in strengthening the web 34. The strengthening features help the web 34 to be self-supporting in extending across the mouth of the gutter when the gutter cover is installed, especially under load of water, wet leaves, snow, etc. The strengthening features also assist in supporting the water collection features (e.g., diverter 50 and channel 52) so they generally retain their intended configuration for effectively passing water through the web 34. Moreover, the strengthening features are arranged to define predetermined flex locations in the web to promote flexing of the web at the flex locations rather than at water collection features, if the web is required to conform for an installation on a particular gutter/roof.

The strengthening features comprise a plurality of ridges formed in the web. Some of the ridges, referred to herein as longitudinal ridges 70 or longitudinal beads, like the ridge of the diverter 50, extend in a longitudinal direction along the length of the gutter cover 10. Other ridges, referred to herein as transverse ridges 72 or transverse ribs, extend transversely with respect to the longitudinal ridges 70 widthwise with respect to the gutter cover. In the illustrated embodiment, three longitudinal ridges 70A-70C are provided. First and second longitudinal ridges 70A, 70B are located in front of the diverter 50, and a third longitudinal ridge 70C is located behind the diverter. The illustrated longitudinal ridges 70A-70C have similar constructions. For example, they may be about 3/32 inches tall (broadly, in the inclusive range of 1/16 to 1/4 inch). The illustrated longitudinal ridges 70A-70C comprise radius bends, but other types of bends (e.g., bend defining corner) can be used. The longitudinal ridges 70A-70C have respective rearward facing impact surfaces that promote passage of water through the web 34, like the diverter but on a smaller scale. Other types, numbers, arrangements, and constructions of longitudinal ridges can be used without departing from the scope of the present disclosure. For example, the longitudinal ridges can protrude downwardly instead of upwardly.

In the illustrated embodiment, the web 34 includes two sets of transverse ridges 72. A first or forward set of transverse ridges 72A is located between the first and second longitudinal ridges 70A, 70B. A second set of transverse ridges 72B is located rearward from third longitudinal ridge 70C. The transverse ridges 72A of the first set have lengths (extending widthwise of the gutter cover) of about 1/4 inch (broadly, in the inclusive range of 1/8 to 1/2 inch, more broadly in the inclusive range of 1/8 to 1.5 inches), and are spaced from each other along the length of the cover by about 3/4 inch (broadly, in the inclusive range of 1/4 to 2 inches, equal to or greater than 1/4 inch, or equal to or less than 2 inches). The transverse ridges 72B of the second set have lengths (extending widthwise of the gutter cover) of about 1 inch (broadly, in the inclusive range of 1/4 to 1.5 inches, equal to or greater than 1/4 inch, or equal to or less than 2.5 inches), and are spaced from each other along the length of the cover by about 1.5 inches (broadly, in the inclusive range of 1/2 to 2.5 inches, equal to or greater than 1/2 inch, or equal to or less than 2.5 inches). The transverse ridges 72A, 72B can have a height of about 3/32 inches (broadly, in the inclusive range of 1/16 to 1/4 inch). Other types, numbers, arrangements, and constructions of transverse ridges can be used without departing from the scope of the present disclosure. For example, the transverse ridges can protrude downwardly instead of upwardly.

It will be appreciated that, in the illustrated embodiment, the transverse ridges 72A, 72B do not intersect the longitudinal ridges 70A-70C. The transverse ridges 72A, 72B do not extend to a longitudinal ridge 70A-70C. Segments of the web 34 extending in the reference plane P are located between the ends of the transverse ridges 72A, 72B and the longitudinal ridges 70A-70C. Other configurations can be used without departing from the scope of the present disclosure.

The arrangement of the first and second longitudinal ridges 70A, 70B having the first set of transverse ridges 72A therebetween is believed to provide substantial strength to the web 34 between the diverter 50 and the channel 52.

Although the ridges shown herein (e.g., diverter 50, longitudinal ridges 70A-70C, transverse ridges 72A, 72B) comprise soft or radius bends, it will be understood that the ridges could comprise hard bends defining corners (e.g., corners defining angles of 125 or less degrees, corners defining angles of 100 or less degrees, etc.) without departing from the scope of the present disclosure.

The gutter cover 10 is constructed to be universal in that it is capable of adapting to different configurations of gutters and roofs (e.g., different roof pitches). The web 34 includes multiple flex locations constructed to permit flexing of the web to accommodate different gutters and roof pitches. It will be appreciated that when the gutter cover 10 is installed, the gutter mount 32A (front edge strip) may be fastened (e.g., screwed) to the front lip of the gutter, and the rear end of the gutter cover will usually be installed under shingles of the roof. Thus, the web 34 needs to conform (e.g., adapt to various angles of the reference plane P with respect to the gutter mount) for various installations.

In the illustrated embodiment, the cover 10 is configured such that the reference plane P extends at an angle with respect to the gutter mount 32A corresponding to about a 5.5/12 roof pitch. If the actual roof pitch is 6/12 or greater (more steep), the web 34 can flex to accommodate the roof pitch. Moreover, if the actual roof pitch is 5/12 or less (less steep), the web 34 can flex to accommodate the roof pitch.

In the illustrated embodiment, the web 34 defines multiple flex locations about which the web is flexible to accommodate different installations. For example, the web 34 is flexible at a first flex location 80A (FIG. 3) between the channel 52 and the first longitudinal ridge 70A, and at a second flex location 80B (FIG. 3) between the diverter 50 and the third longitudinal ridge 70C. Desirably, the flex locations 80A, 80B are more readily flexed than the water collection features (e.g., diverter 50 and channel 52) of the web 34 so that the water collection features resist deformation during installation and retain their intended configuration for causing water to pass through the web. However, the water collection features may flex (e.g., at the channel 52) without departing from the scope of the present disclosure. The strengthening features of the web 34 are located to assist in reinforcing the web to help resist deformation of the water collection features, and to help the web to be self-supporting in extending across the mouth of the gutter while carrying load of water, wet leaves, snow, etc. It will be appreciated that, in the illustrated embodiment, the gutter cover lacks bridging structure below the web to support the web to resist loading on top of the web. However, such bridging structure could be provided without departing from the scope of the present disclosure.

It will be appreciated that the various features of the gutter cover 10 described above can be modified or have other configurations, or be implemented in other types of gutter covers, without departing from the scope of the present disclosure. Moreover, in certain embodiments, one or more of the features may be omitted.

In one example, the gutter cover 10 can be manufactured in a roll forming process. Webbing material can be worked, and can have the edge strips 32A, 32B applied and crimped thereon, by a series of rollers of a roll forming machine, to provide the construction of the illustrated gutter cover 10.

Figure 9:
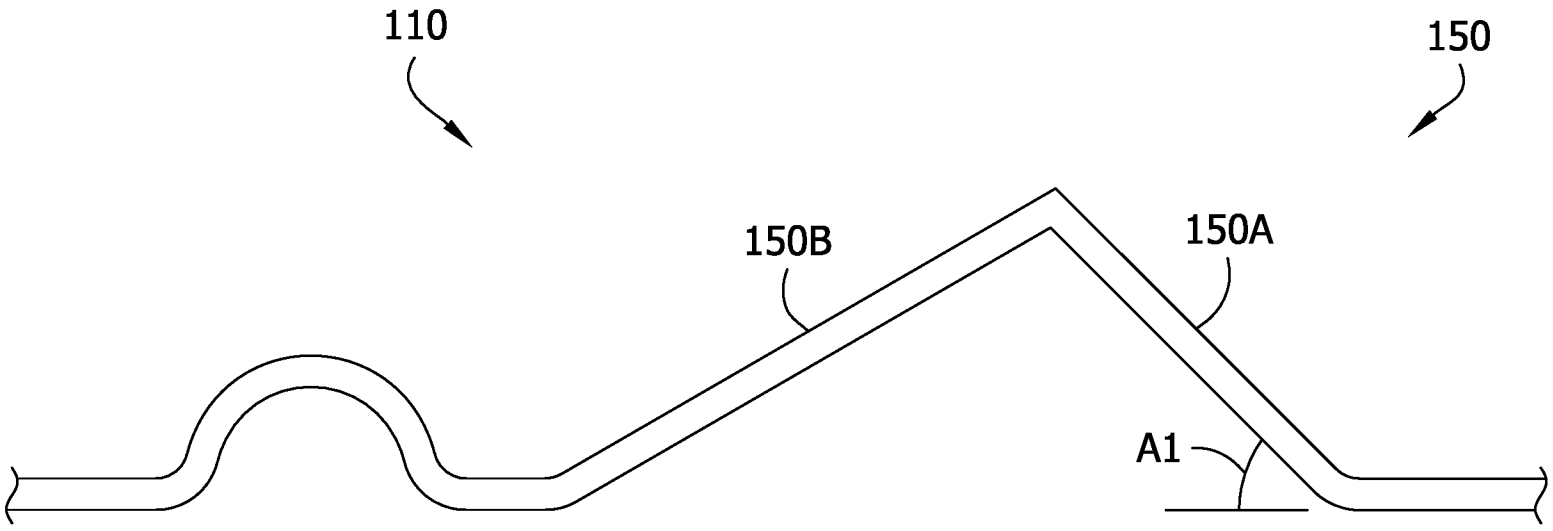
FIG. 9 is an enlarged fragmentary view of a first alternative intermediate portion of the gutter cover.
Figure 10:
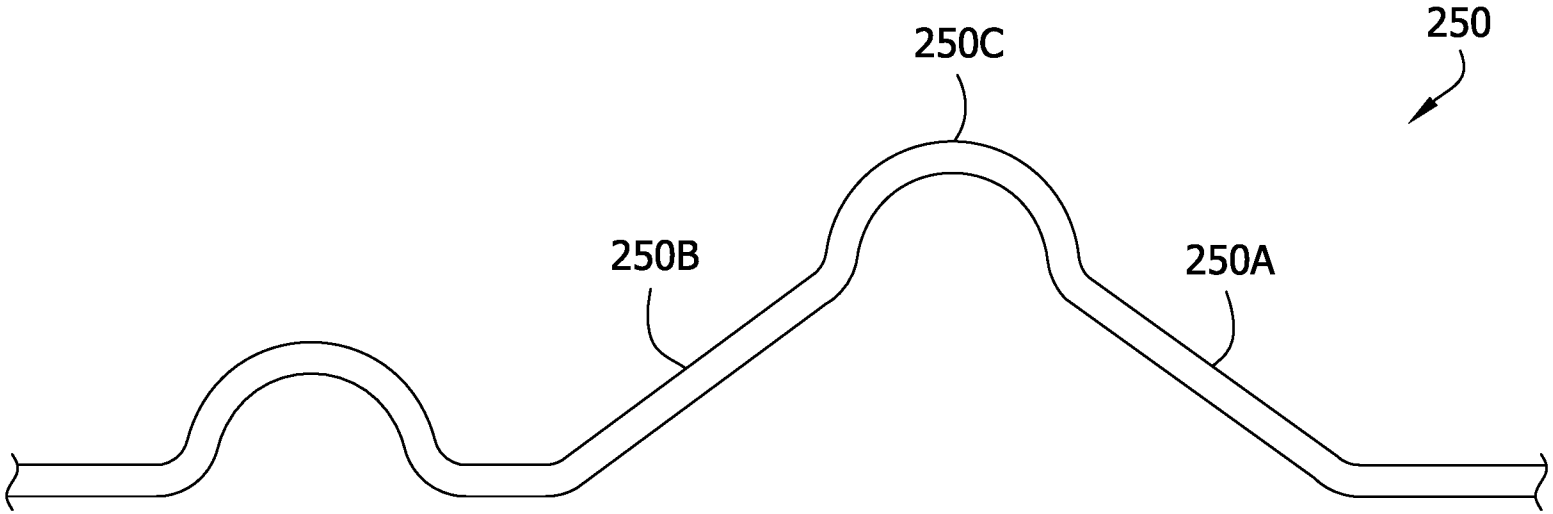
FIG. 10 is an enlarged fragmentary view of a second alternative intermediate portion of the gutter cover.
Figure 11:
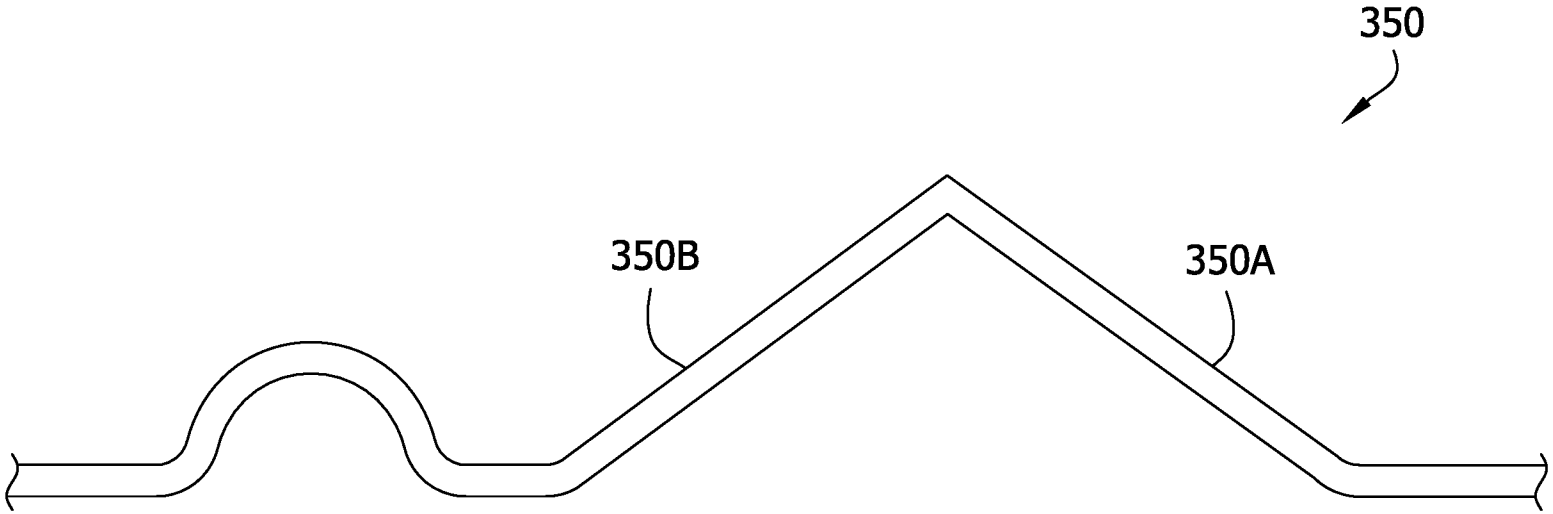
FIG. 11 is an enlarged fragmentary view of a third alternative intermediate portion of the gutter cover.

Referring to FIGS. 9-11, additional embodiments of gutter covers are shown. The gutter covers are essentially the same as the gutter cover 10, except the diverters have different constructions. In the gutter cover 110, the diverter 150 lacks a bead cap but has a shorter rear leg 150A than forward leg 150B. In the gutter cover 210, the diverter 250 has equal length legs 250A, 250B rather than a rear leg shorter than a front leg, and has a bead cap 250C. In the gutter cover 310, the diverter 350 has equal length legs 350A, 350B and lacks a bead cap. It will be appreciated that these and other configurations of diverters can be used to provide an impact surface to break surface tension of the water to promote penetration of the water through the gutter cover.

Figure 12:
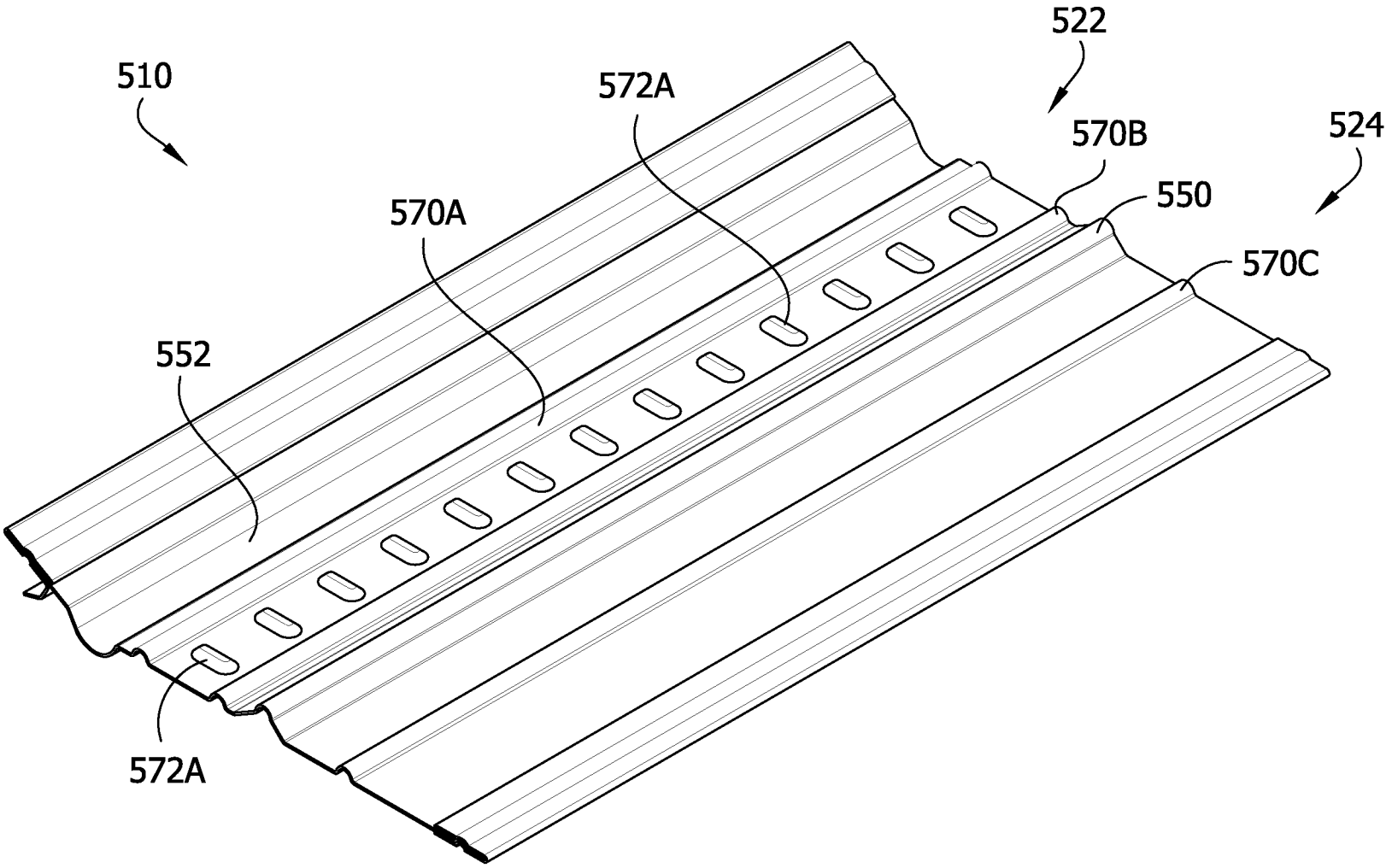
FIG. 12 is a perspective of a second embodiment of a gutter cover of the present disclosure.
Figure 13:
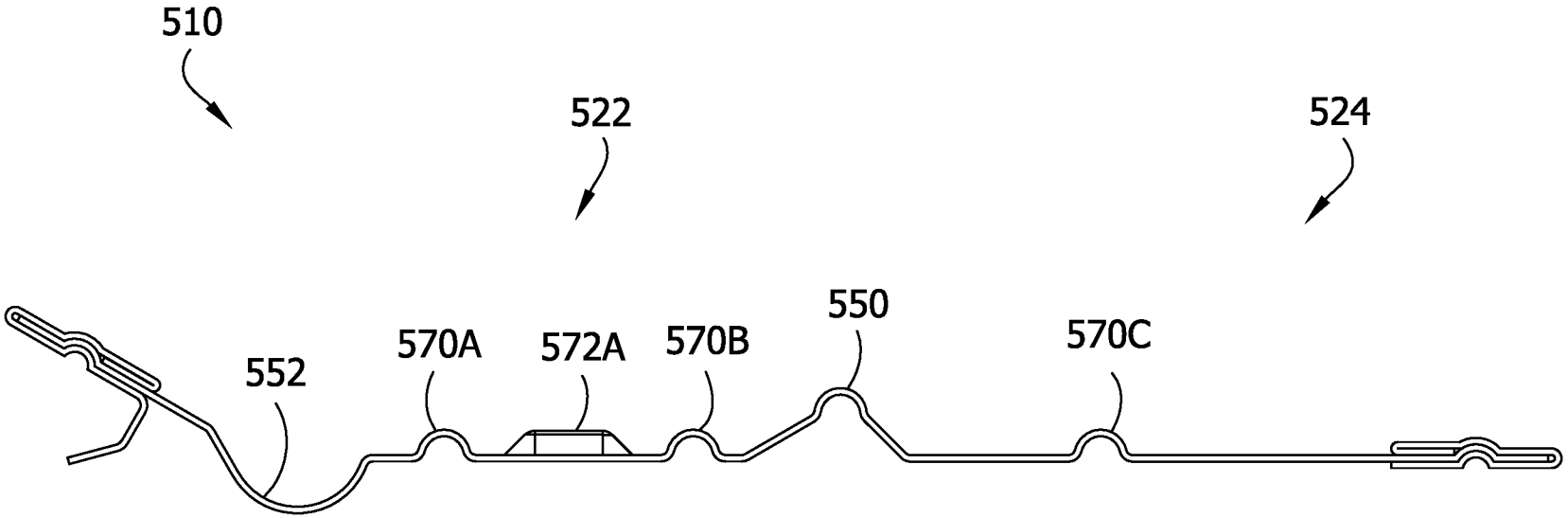
FIG. 13 is right side elevation of the gutter cover of FIG. 12.

Referring to FIGS. 12-13, another embodiment of a gutter cover 510 is shown. The gutter cover 510 is similar to the gutter cover 10, and similar features are indicated by similar reference numbers, plus 500. The gutter cover 10 may be intended for 5", 6", and/or 7" gutters, whereas the gutter cover 510 may be intended for 4" and/or 5" gutters. The gutter cover 510 is not as wide as the gutter cover 10. The water collection section 522 is essentially the same as the collection section 22, including a diverter 550, channel 552, longitudinal ridges 570A-570C, and transverse ridges 572A. But the rear connection section 524 of the gutter cover 510 is not as wide as the connection section 24, and the gutter cover 510 lacks a second, rear set of transverse ridges like ridges 72B. It will be appreciated that if the gutter cover 10 were used on 4" or 5" gutters, a substantial rear portion of the gutter cover would extend under the shingles. The gutter cover 510 has a smaller rear connection section 524 so it does not extend too far under shingles adjacent a 4" or 5" gutter.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A gutter cover for covering a gutter, the gutter cover comprising:

a gutter cover body including an upper face and a lower face, the gutter cover body including a front end, a rear end, and a width extending therebetween, the gutter cover including a left end, a right end, and a length extending therebetween, the front end being configured to be located adjacent to a front lip of the gutter when the gutter cover is installed on the gutter with the upper face facing upward and the lower face facing the gutter;

wherein the gutter cover body comprises mesh material configured to permit water to pass therethrough into the gutter, the mesh material defining a diverter protruding upward and extending lengthwise along the gutter cover body, the diverter having a peak, a rear leg extending upward and forward toward the peak, and a forward leg extending downward and forward from the peak, wherein the rear leg is steeper and shorter than the front leg such that the rear leg defines a water impact surface configured to break surface tension of water flowing rear-to-front along the upper face of the gutter cover body causing the water to pass through the mesh material at the rear leg.

2. The gutter cover of claim 1, wherein the front leg is oriented to provide clearance to permit the water passing through the mesh material at the rear leg to fall rather than impact the lower face of the gutter cover body at the forward leg.

3. The gutter cover of claim 1, wherein the mesh material defines a reference plane and the rear leg deviates from the reference plane at an angle in an inclusive range of from 25 to 80 degrees.

4. The gutter cover of claim 3, wherein the angle is in an inclusive range of from 30 degrees to 60 degrees.

5. The gutter cover of claim 1, wherein the mesh material defines a reference plane and wherein the peak of the diverter is spaced apart above the reference plane along an axis orthogonal to the reference plane by a peak height, the peak height being in an inclusive range of from about 3/16" to about ½ ".

6. The gutter cover of claim 1, wherein the rear leg is straight.

7. The gutter cover of claim 6, wherein the front leg is straight.

8. The gutter cover of claim 1, wherein the front leg is straight.

9. The gutter cover of claim 1, wherein the diverter is about midway between the front end and the rear end of the gutter cover body.

10. The gutter cover of claim 1, wherein the mesh material defines a reference plane and wherein the peak of the diverter is spaced apart above the reference plane along an axis orthogonal to the reference plane by a peak height, the peak height being about 0.25".

11. The gutter cover of claim 1, wherein the mesh material defines a rear bend at a rear end of the diverter and a front bend at a front end of the diverter.

12. The gutter cover of claim 11, wherein the mesh material defines a reference plane and wherein each of the rear bend and the front bend is substantially in-plane with the reference plane.

13. The gutter cover of claim 1, wherein the diverter includes a bead cap along the peak.

14. The gutter cover of claim 1, wherein the diverter lacks a bead cap.

15. The gutter cover of claim 1, wherein the mesh material further defines a raised longitudinal feature protruding upward and extending lengthwise along the gutter cover body.

16. The gutter cover of claim 15, wherein said raised longitudinal feature comprises a rearward facing impact surface for promoting passage of water through the mesh material.

17. The gutter cover of claim 16, wherein said raised longitudinal feature is spaced apart in front of the diverter.

18. The gutter cover of claim 17, wherein the mesh material further defines a longitudinal ridge protruding upward and extending lengthwise along the gutter cover body, the longitudinal ridge being spaced apart rearward of the diverter.

19. The gutter cover of claim 18, wherein the diverter is taller than the longitudinal ridge.

20. The gutter cover of claim 15, wherein the diverter is taller than the raised longitudinal feature.

* * * * *